US005377842A

United States Patent [19]

Sorini

[11] Patent Number: 5,377,842

[45] Date of Patent: Jan. 3, 1995

[54] CONTAINER OF DEVICES FOR COSMETIC AND PERSONAL HYGIENE PURPOSES, SUCH AS MAKE-UP BRUSHES AND SHAVING-BRUSHES, LIPSTICKS, APPLICATORS IN GENERAL, PERFUME DISPENSERS, TOOTHBRUSHES AND SO ON

[75] Inventor: Paolo Sorini, Milan, Italy

[73] Assignee: Sorini & Migliavacca S.p.A., Milan, Italy

[21] Appl. No.: 160,644

[22] Filed: Dec. 2, 1993

[30] Foreign Application Priority Data

Dec. 4, 1992 [IT] Italy ..... MI92A002774

[51] Int. Cl.[6] ..... A45D 44/18; A45D 40/02; A45D 40/26

[52] U.S. Cl. ..... 206/581; 206/823; 206/361; 132/313; 132/315; 132/317; 220/331

[58] Field of Search ..... 220/331, 329, 332; 132/313, 314, 315, 317, 290; 206/581, 823, 361, 15.2, 15.3

[56] References Cited

U.S. PATENT DOCUMENTS

| | | | |
|---|---|---|---|
| 1,978,541 | 10/1934 | Kutter . | |
| 2,074,378 | 3/1937 | Elkins | 206/581 X |
| 4,091,958 | 5/1978 | Zemke | 220/331 X |
| 4,693,364 | 9/1987 | Wakelin | 220/331 X |
| 4,842,132 | 6/1989 | Wells | 132/313 X |
| 4,932,547 | 6/1990 | Rodriquez | 206/581 X |
| 5,095,580 | 3/1992 | Capponi | 132/317 X |

FOREIGN PATENT DOCUMENTS

| | | |
|---|---|---|
| 1481930 | 7/1965 | France . |
| 591636 | 1/1934 | Germany . |

*Primary Examiner*—Paul T. Sewell
*Assistant Examiner*—Jacob K. Ackun, Jr.
*Attorney, Agent, or Firm*—Millen, White, Zelano & Branigan

[57] ABSTRACT

The container comprises a box-shaped base for housing a device for cosmetic and personal hygiene purposes and a cover for closing said base. The cover is translatably and rotatably coupled to the base so as to be movable by translation, subsequent rotation through 180° and further translation from a position of closure of said base to a position of opening and support of the base itself for working access to the aforesaid device. Support means for the device are provided and inserted in said base in a longitudinally sliding manner and are coupled to said cover so that the movement of opening of the latter is automatically accompanied by a translation of the device from a rest position wherein it is completely withdrawn inside said base to a working position wherein it is partially extracted from the aforesaid base. (FIG. 9).

17 Claims, 7 Drawing Sheets

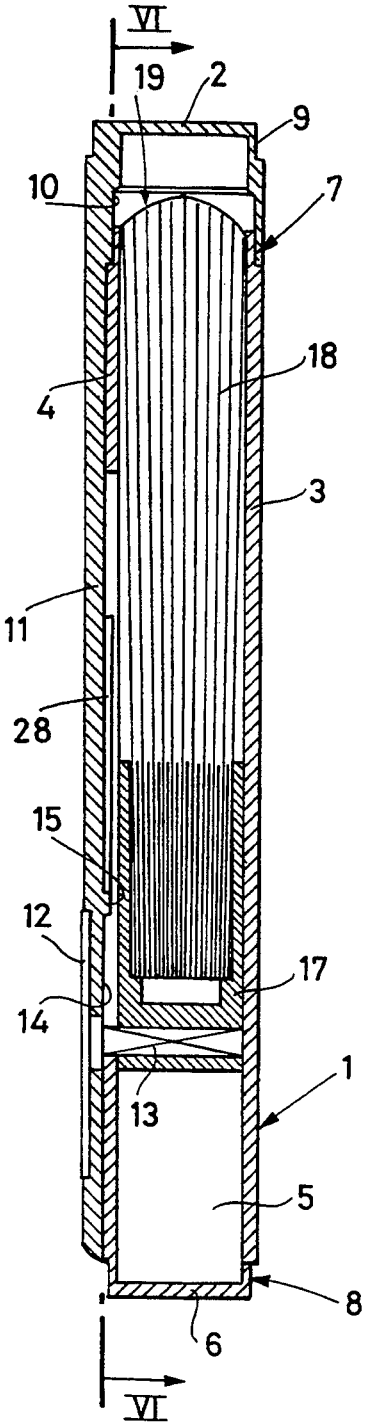
Fig.4
Fig.2
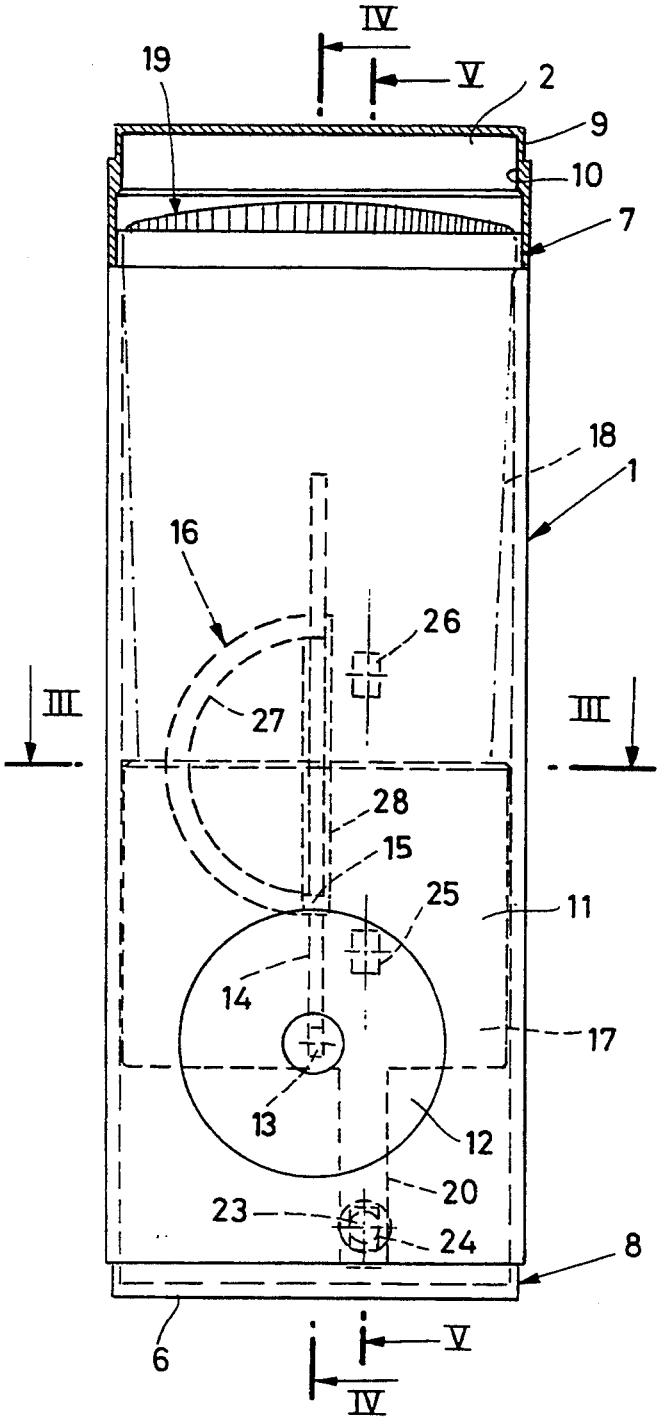
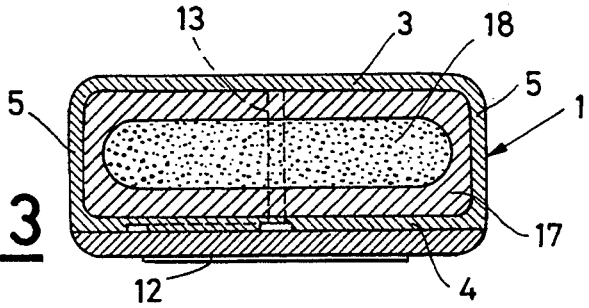
Fig.3

CONTAINER OF DEVICES FOR COSMETIC AND PERSONAL HYGIENE PURPOSES, SUCH AS MAKE-UP BRUSHES AND SHAVING-BRUSHES, LIPSTICKS, APPLICATORS IN GENERAL, PERFUME DISPENSERS, TOOTHBRUSHES AND SO ON

The present invention relates to a container of devices for cosmetic and personal hygiene purposes, such as make-up brushes and shaving-brushes, lipsticks, applicators in general, perfume dispensers, toothbrushes and so on.

Almost all the aforementioned devices, when no longer in use, have to be placed inside a closed container which protects them from dirt, insects and contamination in general.

For this purpose use is normally made of a container consisting of two separable parts, including a base for temporarily or permanently containing the device and a cover for closing said base.

Naturally when the device has to be used the container must be opened and at least the cover must be removed for access to the working part of the device.

This means having to rest the cover or the whole container somewhere, possibly in an unstable and awkward position, and then, naturally, having to remember to retrieve it and reclose it.

Moreover, if the device with relative container is placed in a handbag or suitcase, the container may open and allow the device to fall out with foreseeable consequences for the cleanliness of the device and of the actual handbag or suitcase wherein it has been placed.

The object of the present invention has been that of providing a container of devices for cosmetic and personal hygiene purposes, such as make-up brushes and shaving-brushes, lipsticks, applicators in general, perfume dispensers, toothbrushes and so on, which avoids the aforementioned disadvantage and which is particularly suitable for transporting in bags, suitcases etc.

In accordance with the invention, a container has been provided comprising a box-shaped base for housing the device and a cover for closing said base, characterised in that said cover is translatably and rotatably coupled to said base so as to be movable by translation, subsequent rotation through 180° and further translation from a position of closure of said base to one of opening and support of said base for working access to said device, device support means also being provided which are inserted in said base in a longitudinally sliding manner and are coupled to said cover so that the movement of opening of the latter is automatically accompanied by a translation of the device from a rest position wherein it is completely withdrawn inside said base to a working position wherein it is partially extracted from the abovementioned base.

In other words, in the container according to the invention, the cover is no longer separable from the base, but is instead still restrained by it so as to be able to open the base and at the same time make the device operative and then close the base again, at the same time putting the device away.

The problem no longer arises of where to put the cover during use of the device nor that of remembering to replace it after use nor finally that of undesirable opening of the container when it is carried in a bag or suitcase.

Naturally the device housed in the container can be of whatsoever type, from a make-up brush to a shaving-brush, a lipstick, a perfume bottle, a toothbrush and so on.

It is therefore only by way of a non-limiting example that the following detailed description of an embodiment of the container according to the invention, illustrated in the accompanying drawings, will be given in relation to a make-up brush container.

The present application is in fact understood to refer in general to a container of devices for cosmetic and personal hygiene purposes of whatsoever nature.

In the drawings:

FIG. 2 shows the same container closed and seen from behind;

FIG. 3 shows said closed container sectioned along line III—III of FIG. 2;

FIG. 4 shows said closed container sectioned along line IV—IV of FIG. 2;

Figure 1:
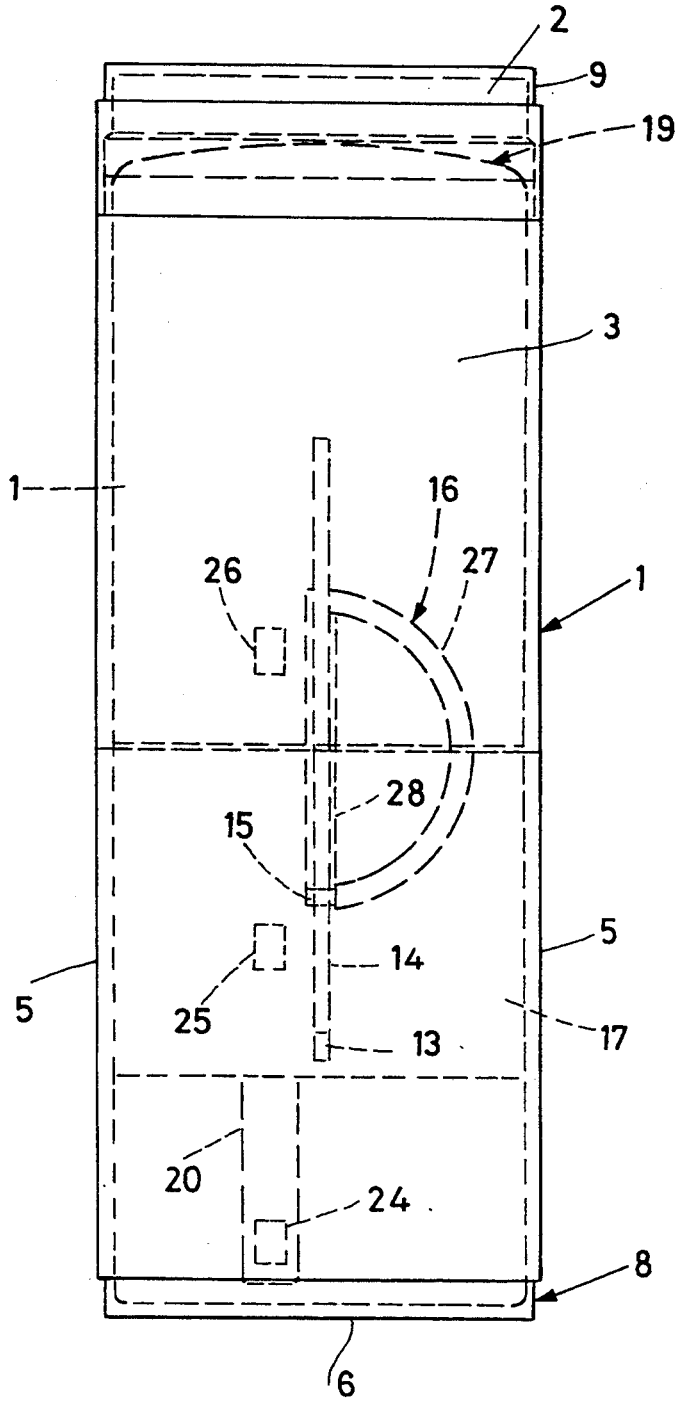
FIG. 1 shows a front view of a container for a make-up brush, according to the invention, in a closed position.
Figure 5:
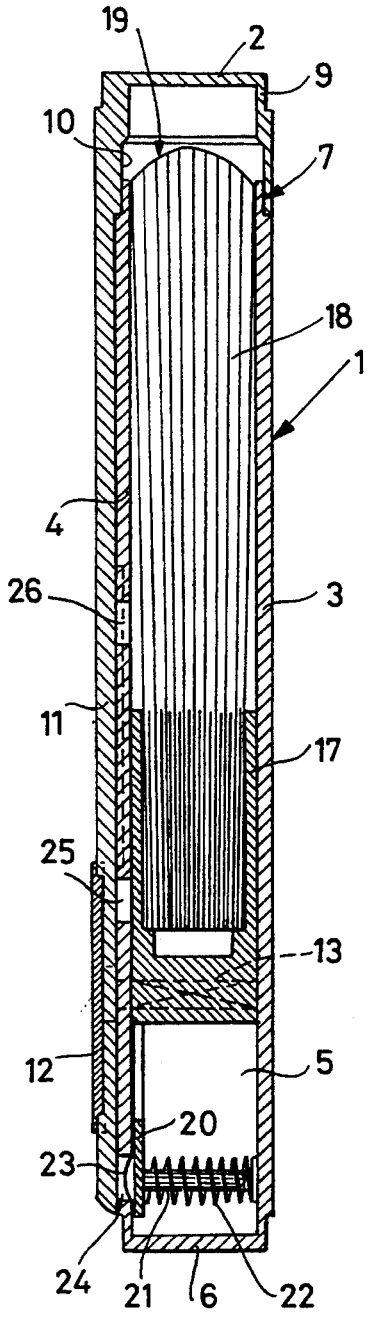
FIG. 5 shows said closed container sectioned along line V—V of FIG. 2.
Figure 6:
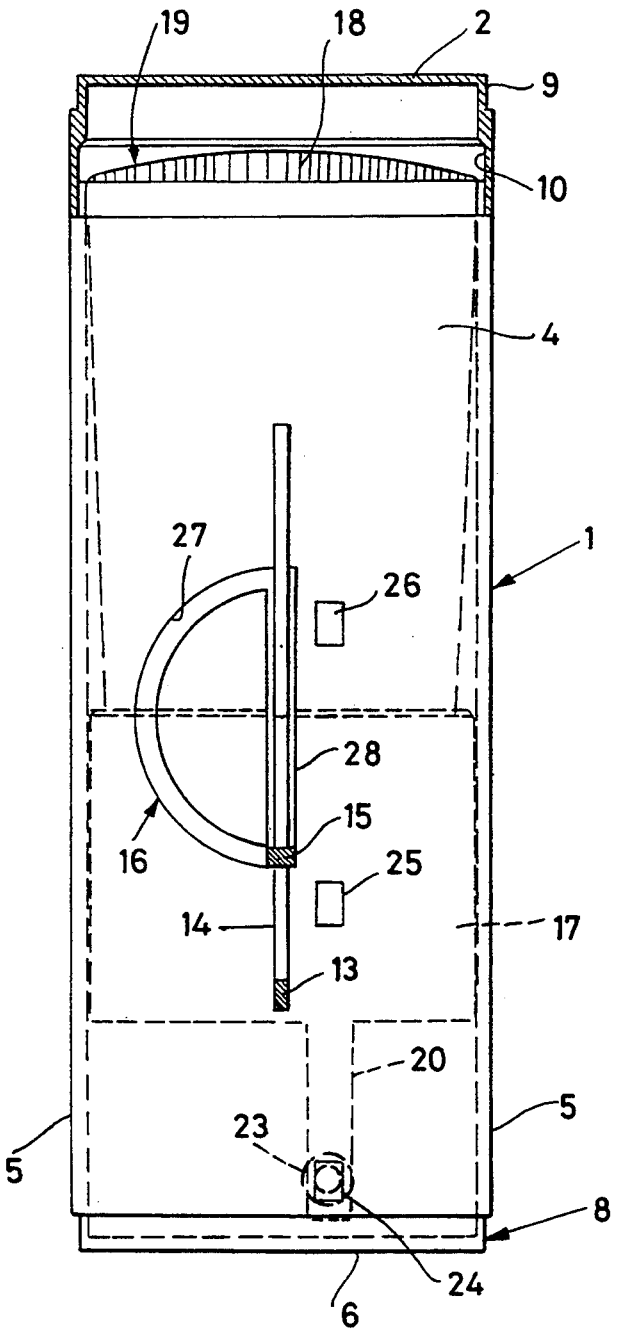
FIG. 6 shows said closed container sectioned along line VI—VI of FIG. 4.

Referring to FIGS. 1–6, which show the container in a closed position, the container illustrated by way of an example essentially consists of a paralleliped box-shaped base 1 and of a cover 2, also paralleliped and box-shaped, used to close the base 1.

The base 1 is formed by a front wall 3, by a rear wall 4, by two side walls 5 and by a bottom wall 6. At the two upper and lower ends, the walls 3, 4 and 5 have recesses defining respective end edgings 7 and 8, smaller in size.

Figure 13:
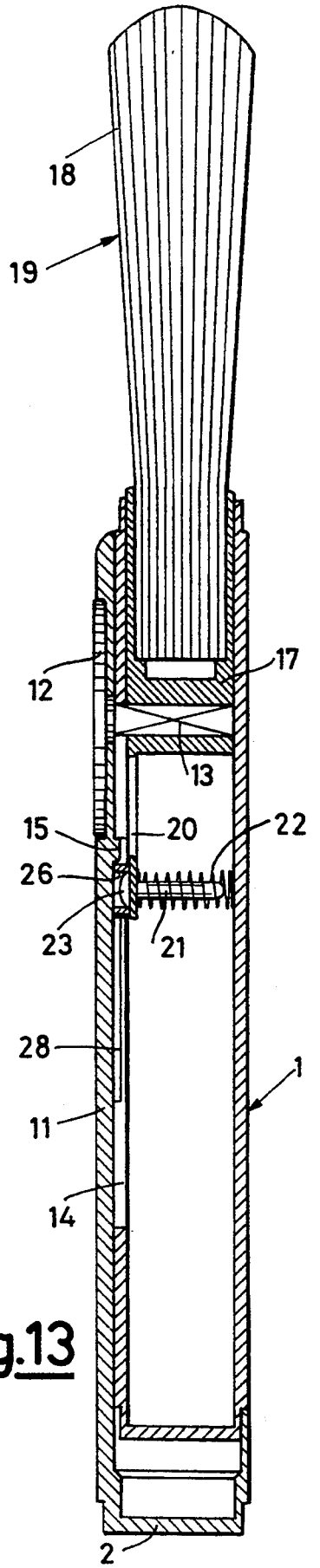
FIGS. 12 and 13 show said container sectioned as in FIGS. 10 and 11, respectively, but with the cover made to translate further in an opposite direction at the end of the movement of opening.
Figure 12:
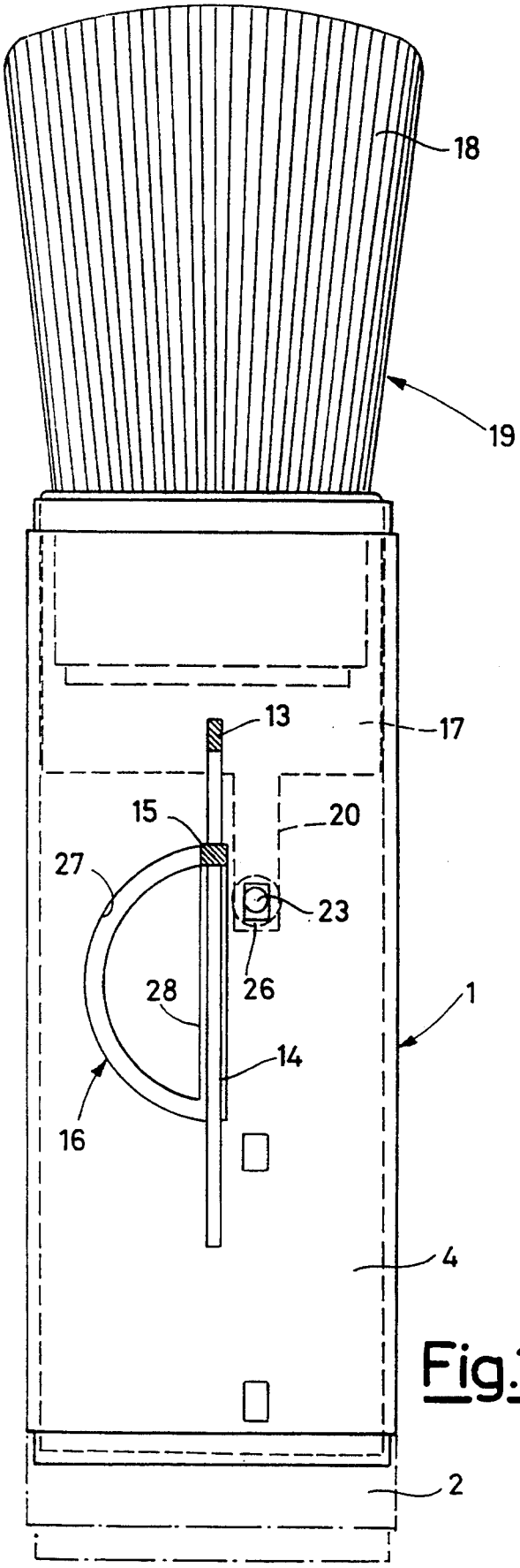

The cover 2 is shaped similarly and complementarily to the base and comprises in particular an external narrowed edging 9 and an internal niche 10 for accommodating one or the other of the two end edgings 7 and 8 of the base 1 according to whether it is in a closed position as in FIGS. 1–6 or in an open position as in FIGS. 12 and 13.

A flat arm 11 extends from the cover 2 parallel to the rear wall 4 of the base 1, and rotates on a wide rotation pin 12 provided with a paralleliped shank 13 housed slidingly in an axial rectilinear groove 14 of the rear wall 4 of the base 1.

Moreover a ratchet 15 extends from the abovementioned flat arm 11 towards the rear wall 4 of the base 1, said ratchet being slidingly housed in a further groove 16 of the same rear wall, which is formed by a semicircular section 27 and a rectilinear section 28 which connects the two ends of the semicircular section 27 and coincides with a part of the abovementioned axial groove 14.

A box-shaped support 17 for a tuft of bristles 18 defining as a whole a make-up brush 19 is slidingly housed inside the base 1 and is integral with the abovementioned shank 13 of the rotation pin 12.

A flexible arm 20 extends in turn from the support 17 downwards and bears at its free end a peg 21, whereon a spring 22 is wound which, by reacting against the front wall 3 of the base 1, pushes elastically a widened head 23 of the peg 21 into one or the other of three windows 24, 25 and 26, formed at different heights in the rear wall 4 of the base 1 according to the closed (FIGS. 1–6), half-open (FIGS. 7–11) or open (12–13) position of the cover 1.

The structure described above provides the following mode of operation of the container illustrated in the drawings.

In the rest position illustrated in FIGS. 1–6, the support 17 of the brush 19 is in a position of maximum withdrawal with the bristles 18 housed almost entirely inside the base 1. This position is made stable by the engaging of the head 23 of the peg 21 in the window 24 of the rear wall 4 of the base 1.

The cover 2 is attached on the top of the base 1 to close off access to the internal space of the base itself and hence to the brush 19.

The shank 13 and the ratchet 15 of the flat arm 11 are in turn situated at the lower ends of the grooves 14 and 16 of the rear wall 4 of the base 1.

Figure 8:
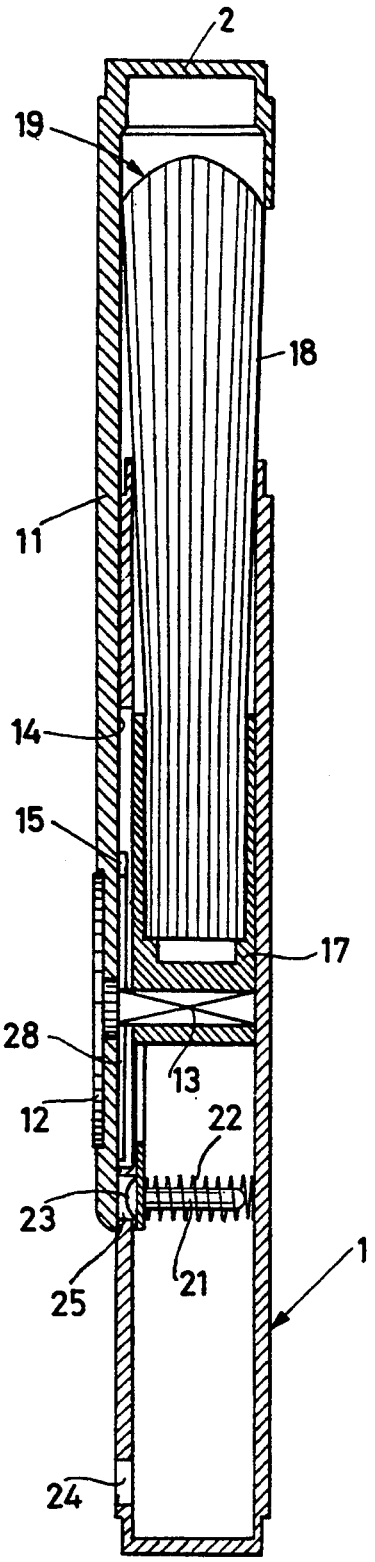
FIG. 8 shows said container sectioned along line VIII—VIII of FIG. 7.
Figure 7:
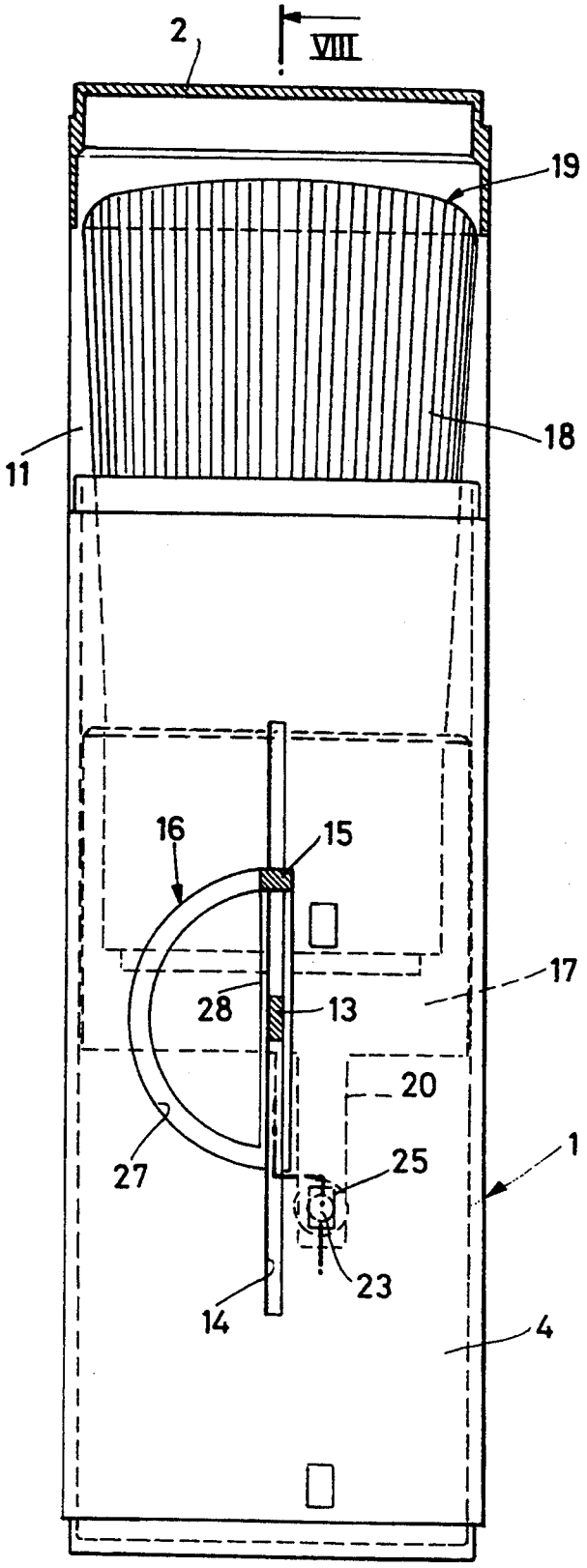
FIG. 7 shows said container sectioned as in FIG. 6, but with the cover made to translate in relation to the base at the beginning of a movement of opening.

In order to open the container and be able to use the brush 19 it is necessary first of all to translate the cover 2 upwards, exploiting for this purpose the sliding engaging of the shank 13 in the vertical groove 14 of the base 1 and of the ratchet 15 in the vertical section 28 of the groove 16 and in this way reaching the position of FIGS. 7 and 8, wherein the ratchet 15 is positioned at the upper end of the groove 16. Consequently, the support 17 is also raised, achieving the intermediate position defined by the engaging of the head 23 of the peg 21 in the window 25 of the rear wall 4 of the base 1.

Figure 9:
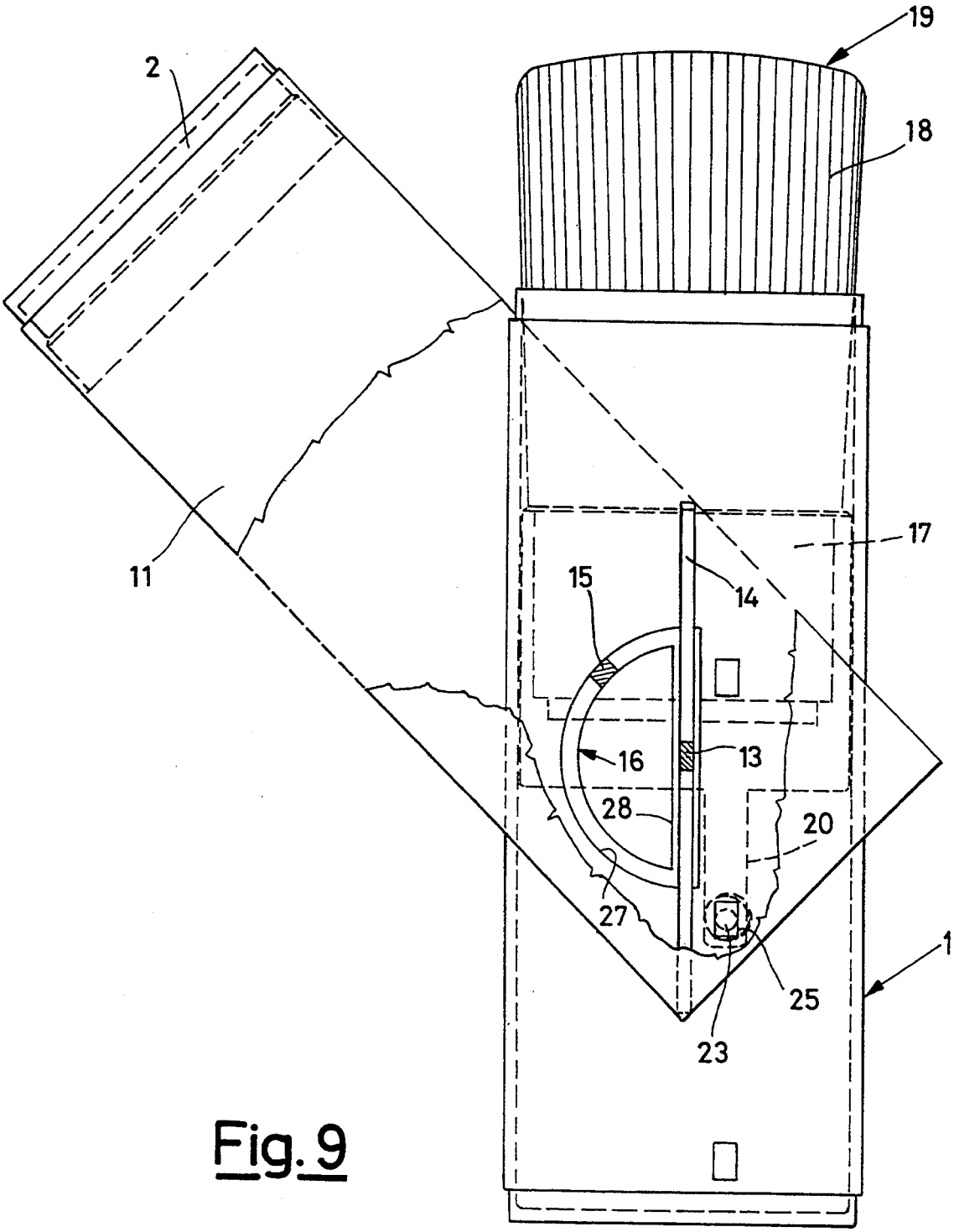
FIG. 9 shows said container sectioned as in FIG. 6, but with the cover partially rotated in a phase subsequent to the movement of opening.

It is then possible to rotate the cover 2 around the axis of the pin 12, exploiting the sliding of the ratchet 15 in the semicircular section 27 of the groove 16, as shown in FIG. 9.

Figure 11:
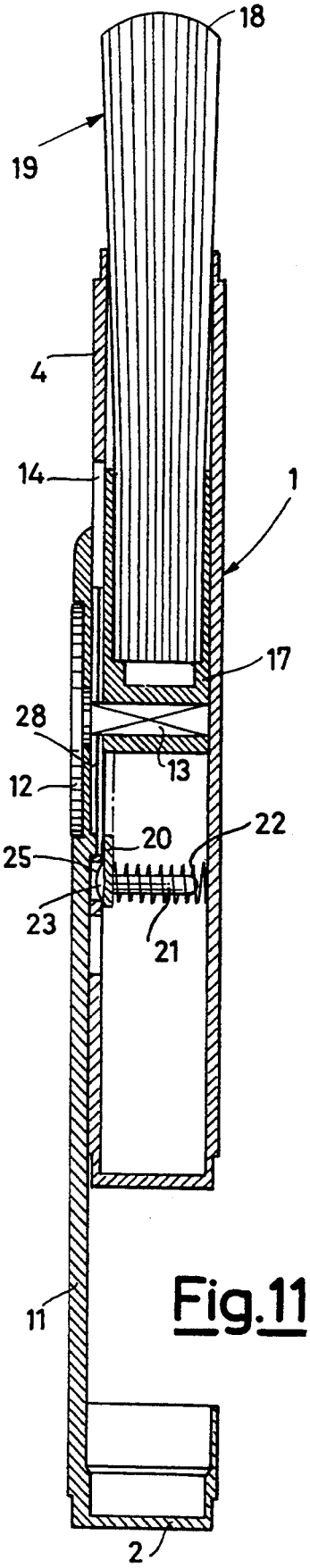
FIG. 11 shows said container sectioned along line XI—XI of FIG. 10.
Figure 10:
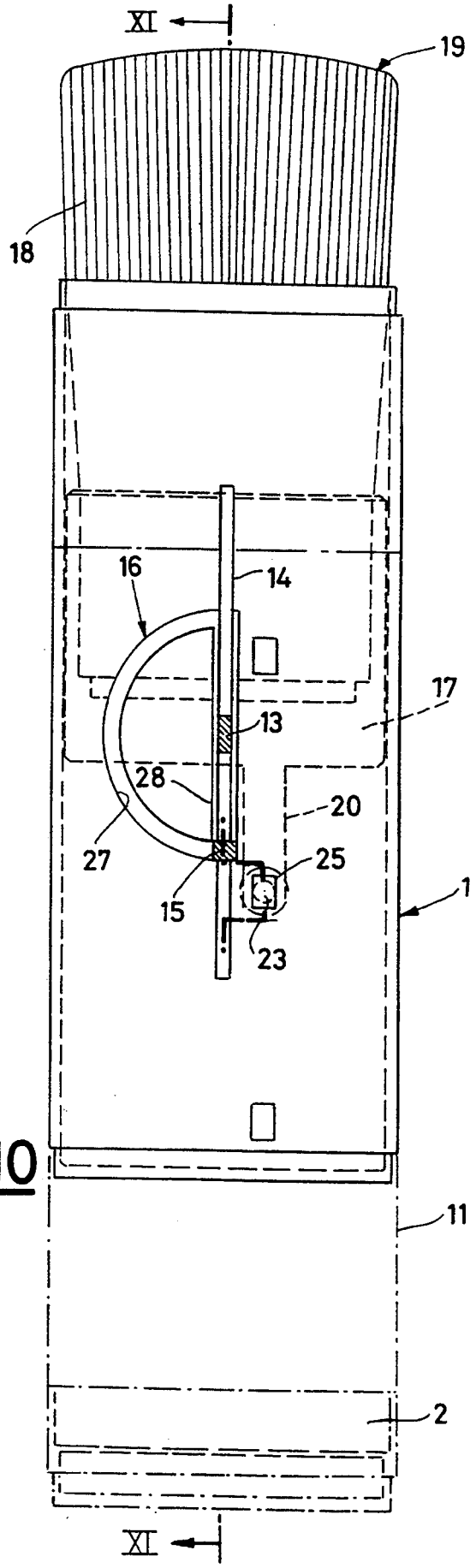
FIG. 10 shows said container sectioned as in FIG. 6, but with the cover at the end of the opening rotation.

After rotating through 180°, the position of FIGS. 10 and 11 is thus reached, wherein the ratchet 15 has arrived at the lower end of the groove 16.

Finally the additional vertical translation of the cover 2 is performed, which, by exploiting the sliding of the shank 13 in the groove 14 and of the ratchet 15 in the vertical section 28 of the groove 16, brings the cover to be coupled to the lower edging 8 of the base 1 to form a single body therewith to support the base and the brush 19, which now has all the bristles 18 extracted from the base 1 and is ready for use subsequent to the simultaneous translation of the support 17 into the raised position of FIGS. 12 and 13, defined by the engaging of the head 23 of the peg 21 in the window 26 of the rear wall 4 of the base 1.

Naturally the reverse movement must be performed in order to return the container into the closed position with the brush 19 fully withdrawn into the base 1, in turn closed by the cover 2 as shown in FIGS. 1–6.

I claim:

1. A container for cosmetic or personal hygiene devices, comprising:

a box-shaped base having a longitudinal axis and a cover for closing said base;

a device-support longitudinally slidably housed in said base;

first connecting means arranged between said base and said cover to allow translation of said cover along said longitudinal axis of said base and rotation thereof through 180° so that said cover is movable between a closed position on said base and an open position below said base; and, second connecting means arranged between said cover and said device-support so that motion of said cover between said closed position and said open position causes longitudinal translation of said device-support and thereby said device between a rest position wherein said device is withdrawn inside said base and a working position wherein said device is partially extracted from said base.

2. The container of claim 1 including yieldable, locking means for defining said rest position and said working position of said device.

3. The container of claim 2 wherein said yieldable, locking means further defines an intermediate position at which position rotation of said cover is begun.

4. The container of claim 3 including a plurality of housing windows in said base; and, wherein said yieldable locking means comprises a catch element carried by said device-support for engagement with one or another of said housing windows in accordance with the axial position of said support means.

5. The container of claim 4 including a resilient means for urging said catch element into a selected housing window.

6. A container according to claim 1 including a rotation pin attached to said device-support and a rectilinear groove along said longitudinal axis of said base; and, wherein said cover includes a flat arm extending therefrom and rotatably coupled thereto by said rotation pin, said rotation pin being slidably housed in said rectilinear groove so that translation of said cover in relation to said base is accompanied by translation of said support means.

7. The container of claim 6 including yieldable, locking means for defining said rest position and said working position of said device.

8. The container of claim 7 wherein said yieldable, locking means further defines an intermediate position at which position rotation of said cover is begun.

9. The container of claim 8 including a plurality of housing windows in said base; and, wherein said yieldable locking means comprises a catch element carried by said device-support for engagement with one or another of said housing windows in accordance with the axial position of said support means.

10. The container of claim 9 including a resilient means for urging said catch element into a selected housing window.

11. The container of claim 6 including a further groove in said base, said further groove including a semicircular section having first and second ends and a rectilinear section extending parallel to said rectilinear groove and connecting said first and second ends of said semicircular section; and, a ratchet member projecting transversely from said flat arm and slidably engagable in said semicircular and rectilinear sections.

12. The container of claim 11 including yieldable, locking means for defining said rest position and said working position of said device.

13. The container of claim 12 wherein said yieldable, locking means further defines an intermediate position at which position rotation of said cover is begun.

14. The container of claim 13 including a plurality of housing windows in said base; and, wherein said yieldable locking means comprises a catch element carried by said device-support for engagement with one or another of said housing windows in accordance with the axial position of said support means.

15. The container of claim 14 including a resilient means for urging said catch element into a selected housing window.

16. The container of claim 15 including end edgings on said base and wherein said cover is shaped complementarily to engage one or another of said edgings according to whether said cover is in said open or said closed position.

17. The container of claim 1 including end edgings on said base and wherein said cover is shaped complementarily to engage one or another of said edgings according to whether said cover is in said open or said closed position.

* * * * *